US006170196B1

(12) United States Patent
Kato

(10) Patent No.: US 6,170,196 B1
(45) Date of Patent: Jan. 9, 2001

(54) APPARATUS FOR KEEPING UPWARDLY SWINGING DOOR OF VEHICLE AT DESIRED ANGLE

(75) Inventor: Kenji Kato, Kariya (JP)

(73) Assignee: Toyota Shatai Kabushiki Kaisha, Kariya (JP)

( * ) Notice: Under 35 U.S.C. 154(b), the term of this patent shall be extended for 0 days.

(21) Appl. No.: 08/932,624

(22) Filed: Sep. 17, 1997

(30) Foreign Application Priority Data

Sep. 26, 1996 (JP) ..... 8-277037

(51) Int. Cl.[7] ..... E05F 11/24

(52) U.S. Cl. ..... 49/331; 49/341; 192/45; 296/56; 296/146.8

(58) Field of Search ..... 49/331, 332, 334, 49/502, 347, 352, 340, 324, 341; 192/45; 296/56, 146.8

(56) References Cited

U.S. PATENT DOCUMENTS

| | | | | |
|---|---|---|---|---|
| 3,470,653 | * | 10/1969 | Kalog | 49/139 |
| 4,191,060 | * | 3/1980 | Sessa | 49/352 |
| 4,499,787 | * | 2/1985 | Leistner et al. | 49/139 |
| 4,534,233 | * | 8/1985 | Hamaguchi | 74/89.2 |
| 4,881,018 | * | 11/1989 | Kato et al. | 49/139 |
| 5,390,763 | * | 2/1995 | Liedtke | 185/39 |
| 5,448,856 | * | 9/1995 | Moore et al. | 49/340 |
| 5,531,498 | * | 7/1996 | Kowall | 296/146.4 |
| 5,563,483 | * | 10/1996 | Kowall et al. | 49/280 |
| 5,779,015 | * | 7/1998 | Murata | 192/45 |
| 5,851,050 | * | 12/1998 | Squire et al. | 49/140 |
| 5,896,703 | * | 4/1999 | Wright et al. | 296/56 |
| 5,921,604 | * | 7/1999 | Yu et al. | 296/56 |

FOREIGN PATENT DOCUMENTS

404182590 * 6/1992 (JP) ..... 49/282

* cited by examiner

*Primary Examiner*—Daniel P. Stodola
*Assistant Examiner*—Curtis A. Cohen
(74) *Attorney, Agent, or Firm*—Pillsbury Madison & Sutro LLP

(57) ABSTRACT

One end of a connection wire is connected to a rear vehicle door which can be popped up by an urging force from a user. An apparatus for maintaining the position of the upwardly swinging rear door once it is opened at a desired angle includes a pulley for receiving the other end of the connection wire wound around it. A power spring urges the pulley in a connection wire-winding direction. A one-way clutch includes a rotatable outer ring with an input shaft at the center thereof. The input shaft is connected to the pulley. The input shaft is also connected to the outer ring through multiple rollers interposed between the outer ring and the input shaft so that the pulley is allowed to rotate in the connection wire-winding direction. In maintaining the upwardly swinging rear door at a desired angle once it is opened, a solenoid is energized to move a stopper into an engaging groove on the periphery of the outer ring. When the stopper engages the engaging groove, the rotation of the outer ring is restricted. In opening or closing the rear door, the solenoid is de-energized to disengage the stopper from the engaging groove. Consequently, the outer ring is allowed to rotate freely.

17 Claims, 7 Drawing Sheets

APPARATUS FOR KEEPING UPWARDLY SWINGING DOOR OF VEHICLE AT DESIRED ANGLE

CROSS-REFERENCE TO RELATED APPLICATION

This application is related to and claims priority from Japanese Patent Application No. Hei 8-277037, incorporated herein by reference.

BACKGROUND OF THE INVENTION

1. Field of the Invention

The present invention generally relates to an apparatus for controlling the movement of a pop-up type door of a vehicle capable of being swung upward at a desired angle, and more particularly to an apparatus for keeping the upwardly swinging door of the vehicle at a desired angle by regulating the feeding amount of a connection wire connecting the door to the vehicle.

2. Description of Related Art

Normally, the upper end of a pop-up type rear door of a van or similar vehicle is connected to the upper side of the rear opening of the body by one or more hinges. A gas-sealed damper is installed at the upper side of the rear opening of the body to allow a user to apply less force when lifting the rear door. Thus, after the upward movement of the rear door is started, the rear door is pressed upward by the extension force of the damper. When space is limited, a large rear door cannot be popped up at a maximum angle or otherwise fully extended. Further, when the rear door is popped up at the maximum angle, the lower edge of the rear door is so high that it may be out of reach of a short person, or it may be necessary for a short person to stretch far to grasp the lower edge of the rear door when closing it. In addition, great force is required to swing the rear door downward against the extension force of the damper.

SUMMARY OF THE INVENTION

In view of the above problems of the prior art, it is an object of the present invention to provide an apparatus for keeping an upwardly swinging door of a vehicle at a desired angle to allow goods or the like to be rapidly loaded in an opening at the rear part of the vehicle body or rapidly unloaded therefrom in a limited space.

It is another object of the present invention to enable a user to apply less force to the door to close it.

In order to achieve the above objects, a first aspect of the present invention provides an apparatus for keeping an upwardly swinging door of a vehicle at a desired angle, and the apparatus includes a door to be urged in a door-opening direction, a connection wire, one end of which is connected to a portion of the door, a pulley mounted on the vehicle body for receiving the connection wire wound thereon, a spring member urging the pulley in a connection wire-winding direction, a rotation restriction device for allowing the pulley to rotate freely when the rotation restriction device is not in operation and restricting rotation of the pulley in a connection wire-feeding direction when the rotation restriction device is in operation, and an operation selection device for controlling the operation of the rotation restriction device or the non-operation thereof.

In this construction, when the rotation restriction device is set to the non-operation state by the operation selection device, the pulley is capable of freely rotating, thus feeding the connection wire forward therefrom. Consequently, the door can be swung upward or in a door-opening direction. When the door is at a desired angle, the rotation restriction device is set to the operation state by the operation selection device. As a result, the forward feeding of the connection wire from the pulley is restricted and the upward swinging of the door is stopped at the desired angle. When the door is pressed downward by a user's hands, the urging force of the spring member allows the pulley to rotate at high speed in the connection wire-winding direction and allows it to receive the connection wire wound thereon. Therefore, the connection wire is prevented from becoming loose.

As described above, the door can be stopped and maintained at a desired angle while it is swinging open and prevented from opening completely. This construction allows goods or the like to be loaded into the vehicle body from the opening at the rear part thereof or unloaded therefrom in a limited space and allows the user to apply less force to the door to open it. According to this aspect of the invention, the door can be maintained at any desired angle without providing a mechanical stopper.

According to a second aspect of the present invention, the rotation restriction device of the apparatus includes an outer ring rotatably mounted on the vehicle body, an input shaft inserted into the center of the outer ring, rotatable relative to the outer ring and connected to the pulley so that the input shaft rotates together with the pulley, a connector interposed between the input shaft and the outer ring and operatively connecting the input shaft and the outer ring with each other when the input shaft rotates in a connection wire-feeding direction relative to the outer ring, and an outer ring operation device engaging the outer ring when the outer ring operation device is in operation, thus restricting the rotation of the outer ring and disengaging from the outer ring when the outer ring operation device is not in operation.

In this construction, when the rotation of the outer ring is not restricted by the outer ring operation device, the input shaft and the pulley operatively connected therewith are capable of rotating freely. Consequently, the connection wire is fed from the pulley and thus the door can be swung upward. The rotation of the pulley in the connection wire-feeding direction, namely, the forward feeding direction, is restricted by restricting the rotation of the outer ring by means of the outer ring operation device when the door has been opened at a desired angle. Therefore, the door is stopped at the desired angle and remaining stationary. When the door is closed with the user's hands, the pulley is rotated by the urging force of the spring member in the connection wire-feeding direction at high speed while the connection wire is wound around it, thus preventing it from becoming loose.

According to the second aspect of the present invention, the operation state of the rotation restriction device can be easily selected by restricting the rotation of the outer ring and releasing the restriction of the rotation thereof.

BRIEF DESCRIPTION OF THE DRAWINGS

These and other objects and features of the present invention will become clear from the following description taken in conjunction with a preferred embodiment thereof with reference to the accompanying drawings throughout which like parts are designated by like reference numerals, and in which.

DETAILED DESCRIPTION OF THE INVENTION

A preferred embodiment of the present invention for keeping a swinging rear door at a desired angle will be described below with reference to the drawings.

Figure 1:
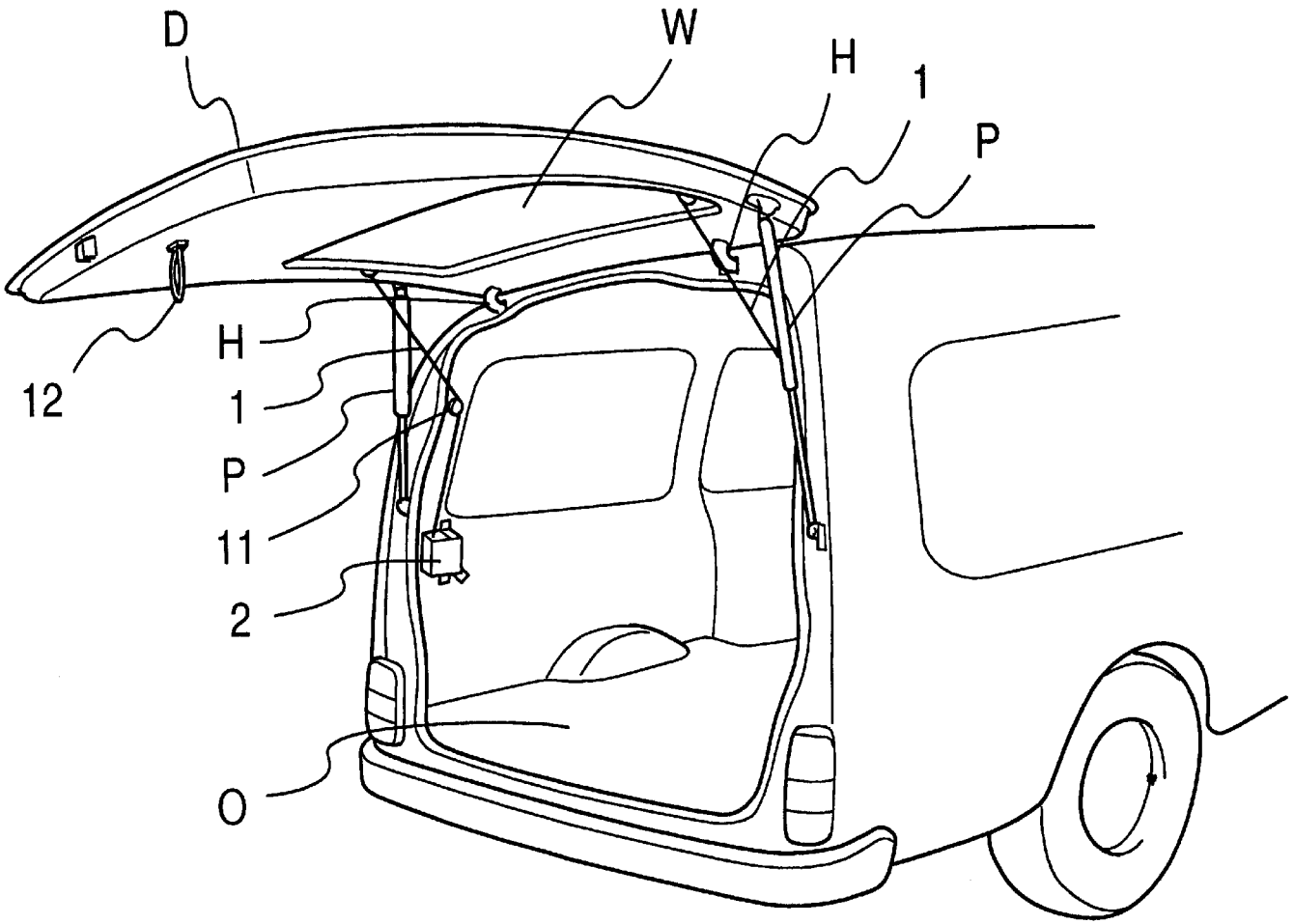
FIG. 1 is a perspective view showing a rear part of a van having an apparatus for keeping a swinging rear door thereof at a desired angle according to a preferred embodiment of the present invention.

FIG. 1 is a perspective view showing a rear part of a van having an apparatus for keeping a swinging rear door thereof at a desired angle according to the preferred embodiment. A pop-up rear door (D) is installed on the rear part of the body of the van to cover a rear opening (O). In the state shown in FIG. 1, the rear door (D) has been popped up to open the rear part of the body. The rear door (D) is connected to the rear part of the body by a pair of hinges (H) installed at the left-hand and right-hand sides of the rear upper part of the body. A pair of gas-filled dampers (P) are provided between the rear door (D) and the rear part of the body to support the rear door (D) when it is popped up by the extension force of the dampers (P). One end of the left-hand side gas-filled damper (P) is mounted on the left-hand edge of the upper part of the rear door (D) and the other end thereof is mounted on the left-hand edge of the rear part of the body, whereas one end of the right-hand gas-filled damper (P) is mounted on the right-hand edge of the upper part of the rear door (D) and the other end thereof is mounted on the right-hand edge of the rear part of the body.

One end of a left-hand connection wire 1 is connected to the left-hand edge of the rear door (D) proximate to a rear windshield (W) on the rear door (D) and the other end thereof is connected to a wire motion regulator 2 on the inner surface of the left-hand side wall of the body, whereas one end of right-hand connection wire 1 is connected to the right-hand edge of the rear door (D) proximate to the rear windshield (W) and the other end thereof is connected to a wire motion regulator 2 on the inner surface of the right-hand side wall of the body, with each connection wire 1 being supported by a guide roller 11 (only the left hand side roller 11 is shown in FIG. 1) installed proximate to the edge of the opening (O).

A switch 12 for stopping the opening of the rear door (D) is mounted on a lower portion of the inner side of the rear door (D) as an operation selection device. The switch 12 is connected to a control circuit (shown in FIG. 4).

Figure 2:
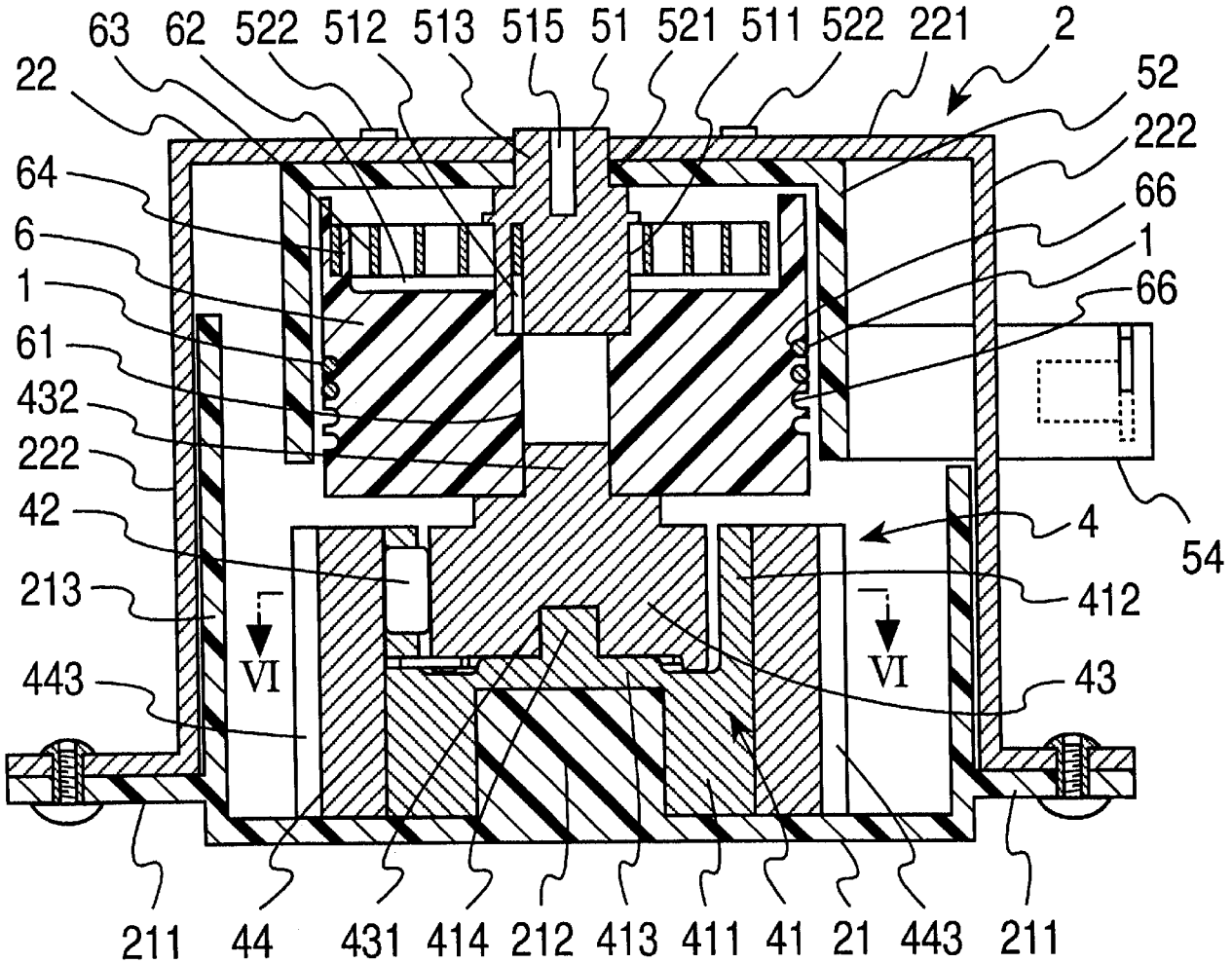
FIG. 2 is an axial cross-sectional view showing the apparatus.
Figure 3:
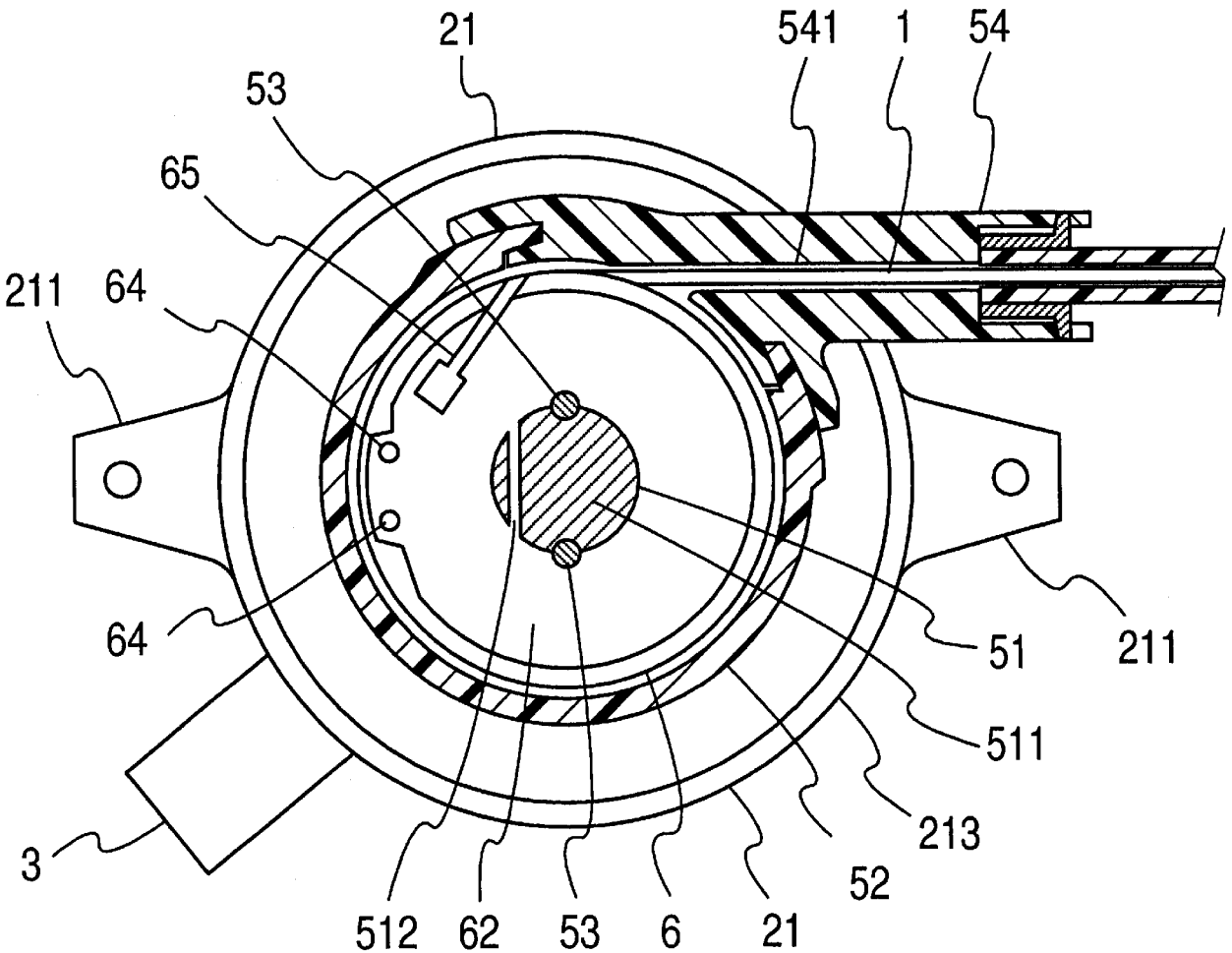
FIG. 3 is a radial partial cross-sectional view showing the apparatus.
Figure 4:
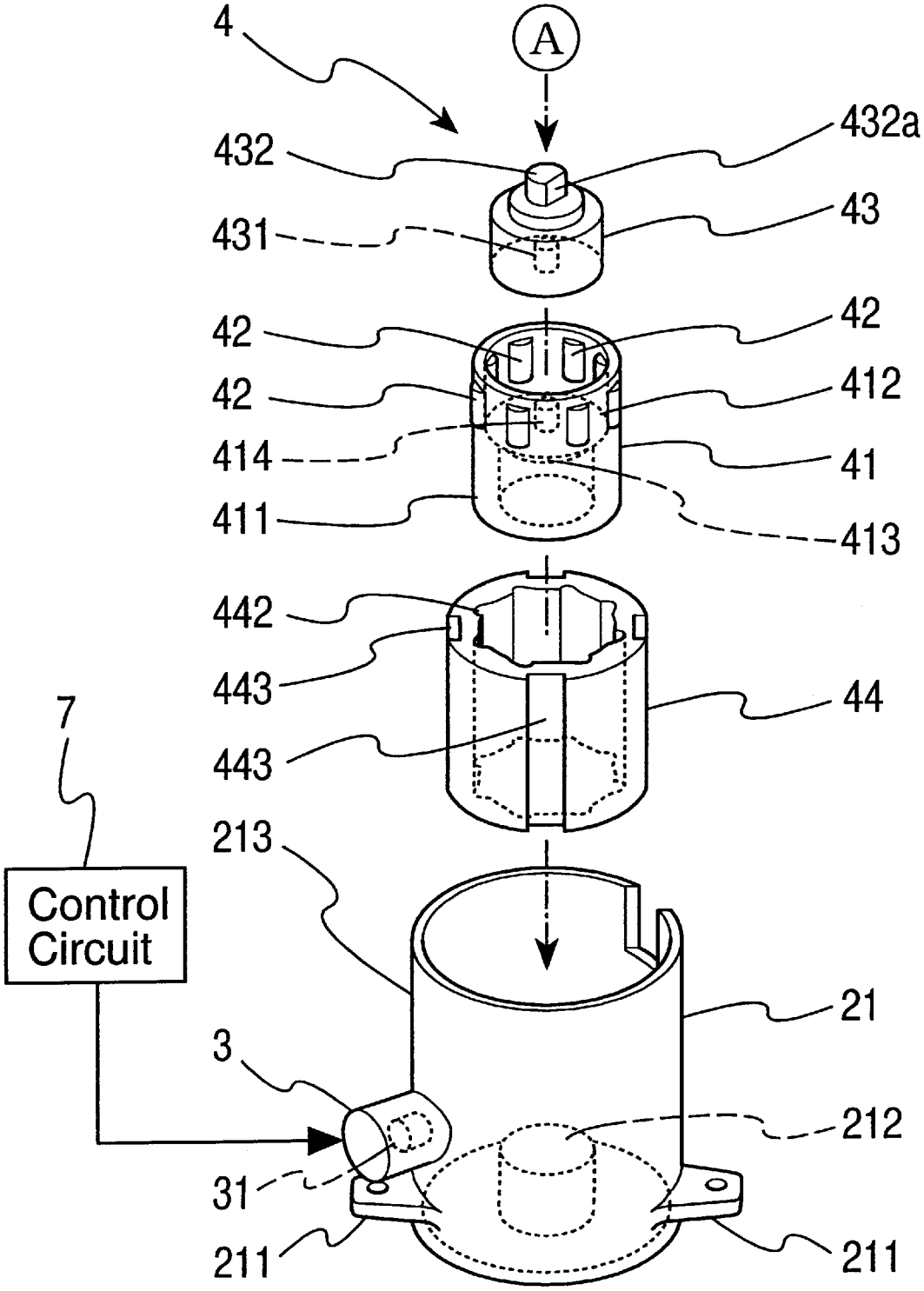
FIG. 4 is an exploded perspective view showing a lower portion of the apparatus.
Figure 5:
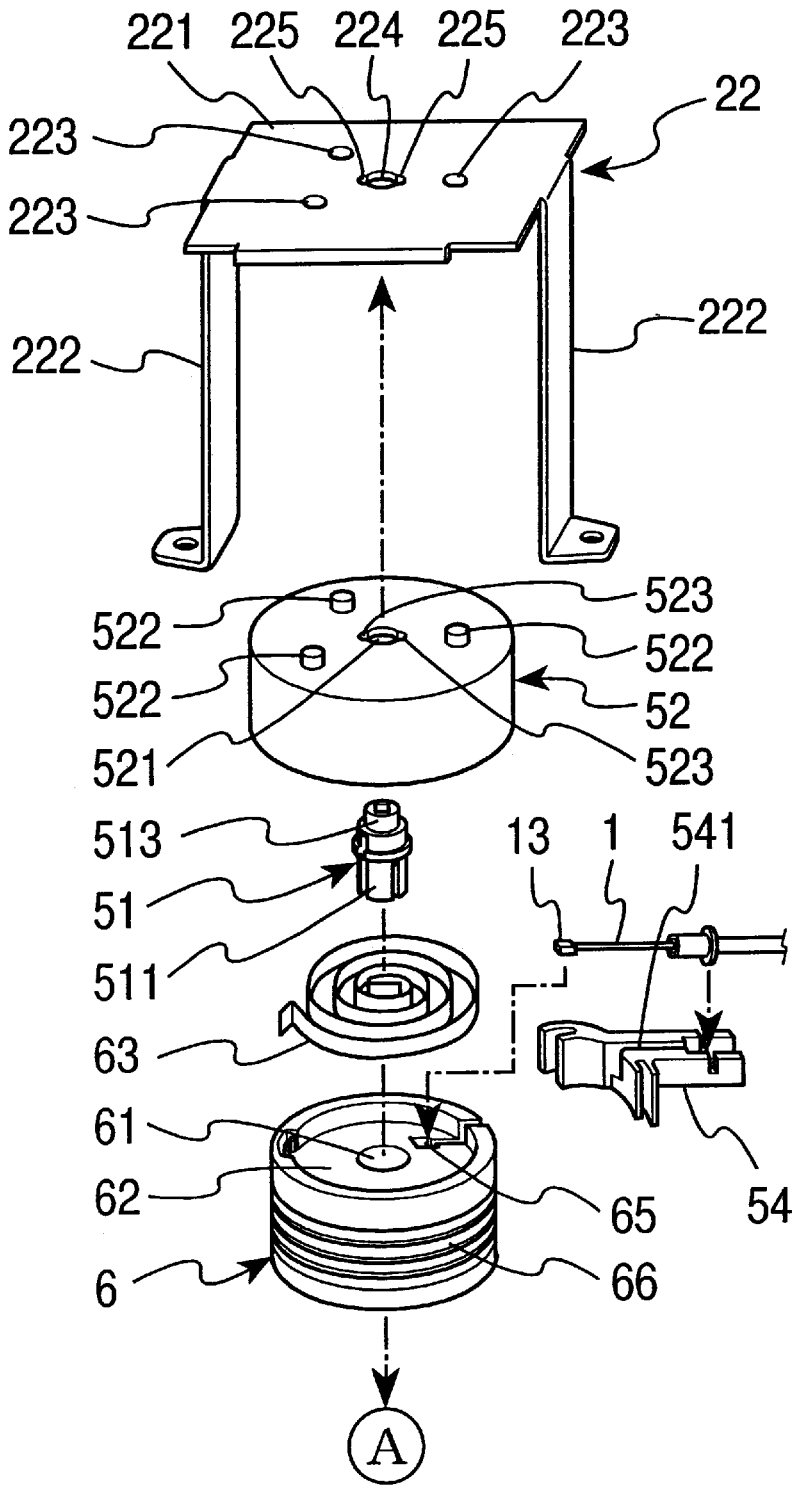
FIG. 5 is an exploded perspective view showing an upper portion of the apparatus.

FIGS. 2–5 show the detailed construction of a wire motion regulator 2 for keeping the rear door thereof popped up at a desired angle. FIG. 2 is an axial cross-sectional view showing the regulator 2. FIG. 3 is a partial radial cross-sectional view showing the regulator 2. FIGS. 4 and 5 are exploded perspective views showing the regulator 2.

The wire motion regulator 2 includes a cylindrical base frame 21 (see FIGS. 3 and 4). The base frame 21 includes a pair of mounting stays 211 projecting radially outwardly from a peripheral wall 213 thereof and a cylindrical vertical projection 212 projecting upward from the center of the bottom surface thereof. A solenoid 3 constituting an outer ring operation device projects from the vertical peripheral wall 213 of the base frame 21. Upon receipt of a signal from a control circuit 7, the solenoid 3 is energized. As a result, a stopper 31 in the solenoid 3 is moved into the interior of the base frame 21.

As shown in FIG. 2, a supporting frame 22 is mounted on the base frame 21. The supporting frame 22 is formed from a pressed metal plate and includes a ceiling plate 221 and a pair of legs 222 projecting downward from opposite edges of the ceiling plate 221. The lower end of each leg 222 is connected to a corresponding one of the mounting stays 211 projecting from the peripheral wall 213 of the base frame 21.

As shown in FIGS. 2 and 4, a holder 41 constituting a one-way clutch 4 serving as a rotation restriction device is inside the base frame 21. The vertical projection 212 of the base frame 21 is rotatably inserted into a lower cylinder 411 of the holder 41 so that the holder 41 can rotate on the vertical projection 212. Multiple rollers 42 serving as a connection device are rotatably held on the cylindrical wall of an upper cylinder 412 of the holder 41. The rollers 42 are spaced at regular intervals in the circumferential direction of the upper cylinder 412. Opposite parts of the peripheral surface of each roller 42 project radially inward and outward from inner peripheral and outer peripheral surfaces of the upper cylinder 412.

An input shaft 43 is rotatably mounted in the upper cylinder 412 of the holder 41. As shown in FIG. 2, the outer peripheral surface of the input shaft 43 contacts the rollers 42. A cylindrical projection 414 of the holder 41 projecting upward from the center of a partitioning wall 413 thereof is inserted into a cylindrical recess 431 of the input shaft 43 at the center of the lower surface thereof. As shown in FIGS. 2 and 4, the input shaft 43 has a stepwise shape so that the diameter of the uppermost cylindrical part 432 is smaller than that of the middle one and that the diameter of the middle one is smaller than that of the lowermost one. As shown in FIG. 4, the upper surface of the uppermost part 432 of the input shaft 43 is vertically partly cut off to form a vertical plane 432*a* thereon.

Figure 6:
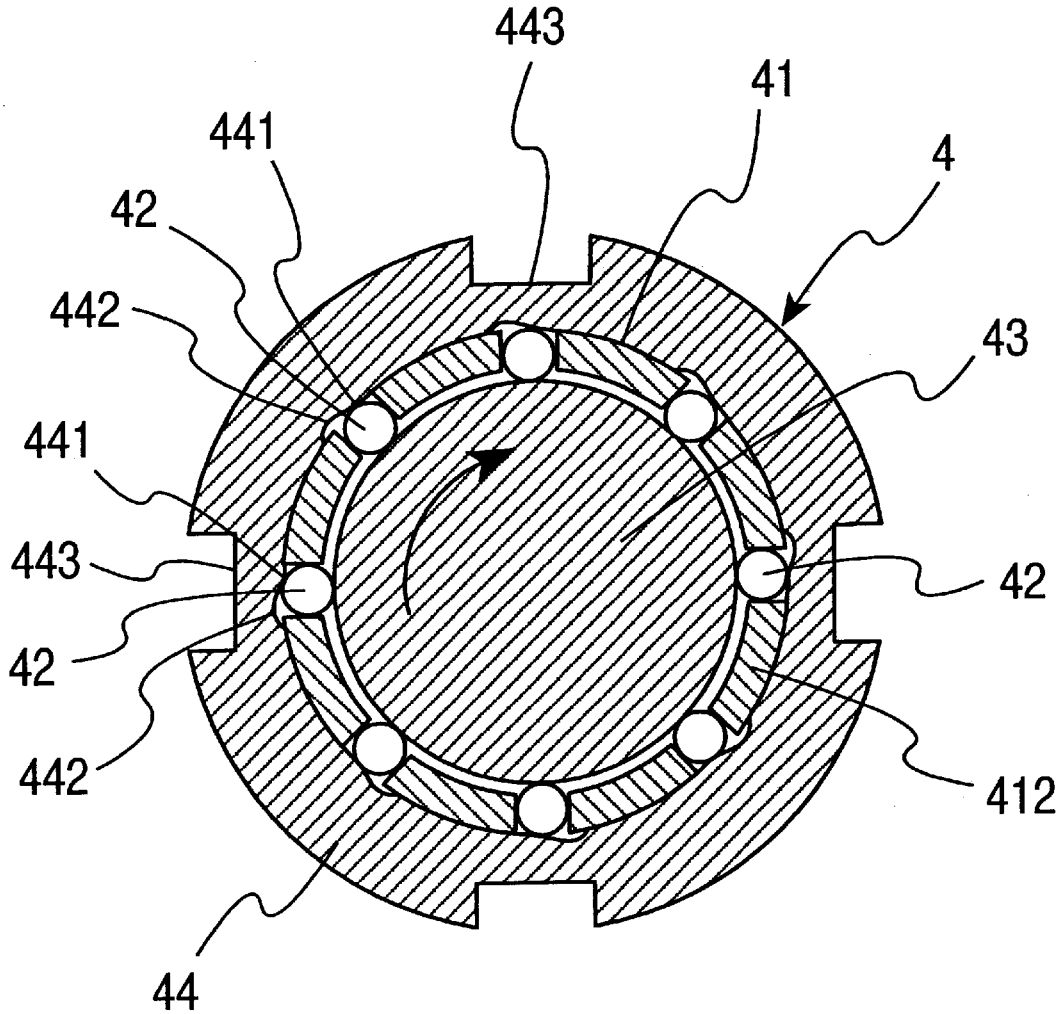
FIG. 6 is a radial cross-sectional view taken along line VI—VI of FIG. 2.

As shown in FIG. 6, a cylindrical outer ring 44 is positioned in the periphery of the holder 41 so that the inner peripheral surface of the cylindrical outer ring 44 contacts the rollers 42. A part of the inner peripheral surface of the outer ring 44 constitutes the space accommodating the rollers 42. That is, parts of inner peripheral surface of the outer ring 44 include slopes 441 and concave surfaces 442. The slopes 441 approaches the peripheral surface of the input shaft 43 gradually in one circumferential direction of the outer ring 44 and the concave surfaces 442 depart greatly from the peripheral surface of the input shaft 43 in the other circumferential direction thereof. Thus, when the input shaft 43 rotates clockwise relative to the outer ring 44, as shown by the arrow of FIG. 6, the rollers 42 are sandwiched between the peripheral surface of the input shaft 43 and the slope 441 of the outer ring 44, with the rollers 42 in contact with the peripheral surface of the input shaft 43 and the slope 441. That is, in this case, the input shaft 43 is connected to the outer ring 44. Consequently, the outer ring 44 rotates clockwise together with the input shaft 43. When the input shaft 43 rotates counterclockwise relative to the outer ring 44, the rollers 42 freely rotate in the space formed by the concave surface 442 of the outer ring 44. That is, in this case, the input shaft 43 is disconnected from the outer ring 44.

A plurality of engaging grooves 443 (four in the embodiment) extending axially are formed on the peripheral surface of the outer ring 44 at regular intervals in the circumferential direction thereof. When the stopper driven by the solenoid 3 engages one of the grooves 443, the outer ring 44 becomes stationary in the circumferential direction thereof.

Figure 7:
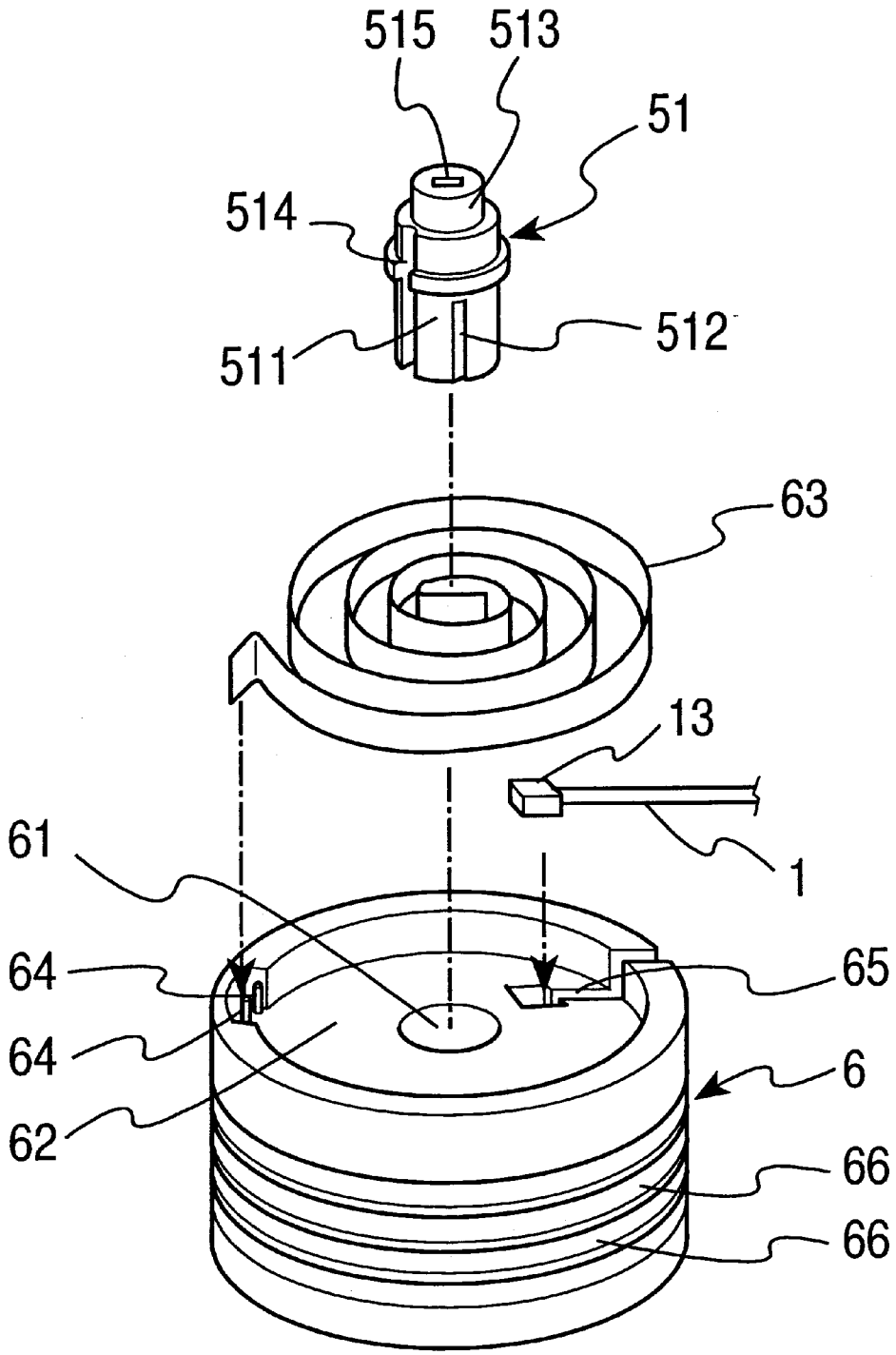
FIG. 7 is an exploded perspective view showing a pulley section of the apparatus.

As shown in FIG. 2, a pulley 6 is arranged upward of the input shaft 43. The sectional shape of a through-hole 61 in the center of the pulley 6 corresponds to that of the uppermost part 432 of the input shaft 43 so that the uppermost part 432 is fixedly received by the lower part of the through-hole 61. The upper part of the through-hole 61 is stepped to form a circular hole in cross-section so that the lower portion of a lower part 511 of a shaft member 51 is rotatably mounted in the recess thus formed as shown in FIG. 7. This construction allows the pulley 6 to rotate together with the input shaft 43, with the pulley 6 held vertically by the shaft member 51.

The upper part of the pulley 6 is stepped downward from the periphery thereof to form an inner part 62 accommodating a power spring 63. Describing the detailed construction of the power spring 63 with reference to FIG. 7, the outer end of the power spring 63 is bent and fixed to the inner part 62 by a pair of pins 64 on the peripheral edge of the inner part 62 of the pulley 6, whereas the inner end of the power spring 63 is bent and locked to the inside of a linear groove 512 inside the lower part 511 of the shaft member 51. Referring to FIGS. 2 and 5, an upper cylindrical part 513 of the shaft member 51 is inserted into a center opening 521 of a pulley guide 52 covering the periphery of the pulley 6 and the upper part thereof. Three projections 522 formed on the upper surface of the pulley guide 52 are inserted into respective mounting holes 223 on the ceiling plate 221 of the supporting frame 22 and fixed thereto by caulking.

Two cut-outs 514, semicircular in a plan view, are formed on the peripheral wall of the shaft member 51 such that the cut-outs 514 are symmetrical with respect to the center of the shaft member 51, although only one cut-out 514 is shown in FIG. 7. In order to stop the rotation of the shaft member 51, pins 53 (see FIG. 3) are inserted into a circular space in the cut-outs 514;

cut-outs 225 are on the inner peripheral edge of an opening 224 formed on the ceiling plate 221 of the supporting frame 22; and cut-outs 523 (see FIG. 5) are on the inner peripheral edge of the center opening 521 of the pulley guide 52.

As shown in FIG. 3, a cut-out is formed on a part of the peripheral wall of the pulley guide 52. One end of a wire guide member 54 is fixedly inserted into the cut-out. A connection wire 1 extending from the rear door (D) is inserted into a center groove 541 of the wire guide member 54. A rectangular locking strip 13 (see FIG. 7) positioned at the front end of the connection wire 1 is fixedly inserted into a locking groove 65 formed in the inner part 62 of the pulley 6. Referring to FIG. 3, the connection wire 1 is wound into a spiral groove 66 (see FIGS. 2 and 7) formed on the peripheral surface of the pulley 6 by rotating the pulley 6 counterclockwise. When the pulley 6 is rotated clockwise by feeding the connection wire 1 forward from the spiral groove 66, the power spring 63 is tightened and deformed, i.e., it is wound tightly around the shaft member 51, thus generating an urging force for rotating the pulley 6 counterclockwise. In order to impart an initial urging force to the power spring 63, with the connection wire 1 wound on the pulley 6, the pins 53 are removed from their cutaways and the end of a screwdriver or other suitable implement is inserted into a groove 515 formed on the upper surface of the shaft member 51 (see FIG. 7); the shaft member 51 is rotated through an appropriate angle to wind the power spring 63 tightly around the shaft member 51; the pins 53 are inserted into the cutaways; and the shaft member 51 is placed in position again.

The operation of the wire motion regulator 2 having the above-described construction is described below.

When the rear door (D) is popped up, the pulley 6 rotates clockwise against the urging force of the power spring 63, thus allowing the connection wire 1 to be fed forward from the circular space. At this time, the input shaft 43 rotates clockwise, together with the pulley 6 as well as the outer ring 44 connected to the input shaft 43 through the rollers 42, as described above. When the switch 12 for stopping the opening of the rear door (D) is turned on after the rear door (D) is swung upward at a desired angle, the solenoid 3 is energized upon receipt of a signal from the control circuit 7. As a result, the stopper 31 moves to the engaging groove 443 of the outer ring 44, thus engaging the engaging groove 443 and stopping the rotation of the outer ring 44. Accordingly, the rotation of the input shaft 43 connected to the outer ring 44 through the rollers 42 is stopped; hence, the rotation of the pulley 6 connected to the input shaft 43 is also stopped. Therefore, the connection wire 1 is prevented from being fed forward from the pulley 6. That is, the swinging motion of the rear door (D) is stopped.

When the rear door (D) is swung downward to close the opening (O) of the rear part of the body of the van by pressing the rear door (D) downward after goods or the like are loaded in the van or unloaded therefrom, the urging force of the power spring 63 is applied to make the pulley 6 rotate counterclockwise. The pulley 6 and the input shaft 43 are connected therewith and are allowed to rotate freely because the input shaft 43 is disconnected from the outer ring 44 as described above. Consequently, the pulley 6 rotates counterclockwise at a high speed, thus winding the connection wire 1 around it at a high speed. Accordingly, the connection wire 1 can be prevented from becoming loose when the rear door (D) is swung downward. Therefore, the connection wire 1 can be prevented from being sandwiched between the rear door (D) and the rear part of the body of the van.

After the rear door (D) is closed completely, the solenoid 3 is de-energized. Thus, the stopper 31 disengages from the engaging groove 443 of the outer ring 44 and departs there-from, and returns to its original position. Therefore, the rear door (D) can be opened again. When the user wishes to alter the rear door-holding angle, after the switch 12 for stopping the opening of the rear door (D) is turned off, the rear door (D) is swung upward at a desired angle. Then, the switch 12 is turned on again.

Although the present invention has been fully described in connection with the preferred embodiments thereof with reference to the accompanying drawings, it is to be noted that various changes and modifications are apparent to those skilled in the art. For example, in its simplest form, the switch 12 may be a push-on, push-off switch or the like which the user manually operates to position the rear door (D). Alternatively, the switch 12 may be integrated with a handle of the rear door (D); it may be implemented in one of the hinges (H) or gas-filled dampers (P) as a motion detector which is used to detect when the motion of the hinges (H) or dampers (P), and thus the rear door (D), falls below a predetermined level, thereby indicating that the rear door (D) has become stationary; or it may be implemented as a balance sensor or a series of mercury switches or the like which provide signals indicating that the door is a one of a series of angular positions.

The rotation restriction device is not limited to the one-way clutch 4, and it is possible to adopt any means which allows the pulley 6 to rotate freely when the rotation restriction device 4 is not in operation and which restricts the rotation of the pulley 6 in the connection wire-feeding direction when the rotation restriction device 4 is in operation. Further, the construction which restricts the rotation of the outer ring 44 is not limited to the combination of the engaging groove 443 and the stopper 31.

In the preferred embodiment, complementary wire motion regulators 2 are provided on opposite sides of the vehicle. If the regulators 2 are mounted in a mirror image fashion, certain aspects of the design thereof may be changed in a manner readily apparent to those skilled in the art. For example, although the regulator 2 of the preferred embodiment permits relative motion between the input shaft 43 and the outer ring 44 when the input shaft 43 moves in a relatively counter-clockwise direction and prevents relatively movement therebetween in the opposite direction, its counterpart will permit movement in the clockwise direction and prohibit movement in the counter-clockwise direction. Alternatively, the sense of the regulators 2 may be the same and the installation position of one may be inverted or otherwise modified according to the arrangement.

Such changes and modifications are to be understood as included within the scope of the present invention as defined by the appended claims unless they depart therefrom.

What is claimed:

1. An apparatus for controlling the motion of a door of a vehicle to be opened to a desired angle, the apparatus comprising:

a connection wire having a first end to be connected to the door and a second end;

a pulley to receive the second end and a portion of the connection wire wound thereon;

a spring member urging the pulley in a connection wire-winding direction;

a spring member urging the pulley in a connection wire-winding direction;

a rotation prevention assembly which, in a first state, allows the pulley to rotate and, in a second state, prevents free rotation of the pulley in a connection-wire feeding direction; and operation selection means for selectively causing the rotation prevention assembly to assume one of the first and second states;

wherein the rotation prevention assembly comprises a rotatably mounted outer ring, an input shaft in a center of the outer ring, rotatable independently of the outer ring and connected to the pulley so that the input shaft rotates together with the pulley, connection means, interposed between the input shaft and the outer ring, for operatively connecting the input shaft and the outer ring to each other when the input shaft rotates in a connection wire-feeding direction relative to the outer ring, and an outer ring operation means for engaging the outer ring when the operation selection means causes the rotation prevention assembly to assume the second state, thus preventing rotation of the outer ring, and for disengaging from the outer ring when the operation selection means causes the rotation prevention assembly to assume the first state.

2. The apparatus of claim 1, wherein the spring member includes a power spring provided along an end surface of the pulley, with one end thereof fixed to an end surface of the pulley and another end thereof fixed to a member supporting the pulley.

3. The apparatus of claim 2, wherein the connection means comprises:

a plurality of rollers, the rollers being sandwiched between a peripheral surface of the input shaft and an inner peripheral surface of the outer ring only when the input shaft rotates relative to the outer ring in the connection wire-feeding direction, thus operatively connecting the input shaft and the outer ring with each other.

4. The apparatus of claim 1, wherein the outer ring operation means comprises:

a solenoid for being energized by a controller when the operation selection means causes the rotation restriction assembly to assume the second state; and a stopper actuated by the energized solenoid to engage an engaging groove formed in a periphery of the outer ring, thereby restricting rotation thereof.

5. An apparatus for controlling motion of a connection member, comprising:

a rotatable pulley for receiving the connection member and winding the connection member thereon;

a one-way clutch rotatable on an axis thereof and connected to the pulley;

the one-way clutch including an input shaft having the pulley mounted thereon, an outer ring having cam portions disposed on an interior surface thereof, and a holder interposed between the input shaft and the outer ring, the holder including rotatable bearings for, when relative movement occurs between the input shaft and the outer ring in a direction permitted by the one-way clutch, engaging with the cam portions and rotating therein and, when relative movement occurs between the input shaft and the outer ring in a direction not permitted by the one-way clutch, engaging the inter surface of the outer ring and an outer surface of the input shaft; and a solenoid selectively engageable with the one-way clutch, the solenoid preventing free rotation of the clutch when engaged therewith.

6. The apparatus of claim 5, further comprising a spring biasing the pulley in a given rotational direction.

7. The apparatus of claim 6, wherein the spring biases the pulley to rotate in a direction of motion permitted by the one-way clutch.

8. The apparatus of claim 5, wherein the input shaft is concentrically disposed within the holder and rotatable therein.

9. The apparatus of claim 5, wherein the holder is concentrically disposed within the outer ring and rotatable therein.

10. The apparatus of claim 5, wherein the outer ring has engagement grooves disposed on an outer surface thereof for engaging with the solenoid.

11. An apparatus comprising:

an automobile having a door pivotably mounted thereon;

a connection member having a first end connected to the door and a second end;

a rotatable pulley for receiving the second end of the connection member and winding the connection member thereon;

a base frame mounted on the vehicle;

a one-way clutch rotatable on the base frame and connected to the pulley;

a spring biasing the pulley to rotate in a direction of motion permitted by the one-way clutch; and a solenoid mounted on the automobile and selectively engageable with the one-way clutch, the solenoid preventing free rotation of the clutch when engaged therewith.

12. The apparatus of claim 11, the one-way clutch comprising:

an input shaft having the pulley mounted thereon;

an outer ring having cam portions disposed on an interior surface thereof;

a holder interposed between the input shaft and the outer ring, the holder including rotatable bearings for, when relative movement occurs between the input shaft and the outer ring in a direction permitted by the one-way clutch, engaging with the cam portions and rotating therein and, when relative movement occurs between the input shaft and the outer ring in a direction not permitted by the one-way clutch, engaging the inner surface of the outer ring and an outer surface of the input shaft.

13. The apparatus of claim 12, wherein the input shaft is concentrically disposed within the holder and rotatable therein.

14. The apparatus of claim 12, wherein the holder is concentrically disposed within the outer ring and rotatable therein.

15. The apparatus of claim 12, wherein the outer ring has engagement grooves disposed on an outer surface thereof for engaging with the solenoid.

16. A method of controlling the motion of a pivotable member mounted on an automobile, the method comprising:

winding a connection member connected to the pivotable member around a pulley connected to a rotatable one-way clutch switchable between a first state allowing the pulley to rotate and a second state restricting free rotation of the pulley in connection member unwinding direction;

moving the pivotable member in a first direction to apply a tensile force to the connection member, the one-way clutch being in the first state, thereby causing the one-way clutch to rotate and unwinding the connection member from the pulley;

switching the one-way clutch to the second state to stop unwinding of the connection member and thus motion of the pivotable member; and moving the pivotable member in a second direction opposite the first direction to wind the connection member around the pulley in a direction permitted by the one-way clutch.

17. An apparatus for controlling the motion of a door of a vehicle to be opened to a desired angle, the apparatus comprising:

a connection wire having a first end to be connected to the door and a second end;

a pulley to receive the second end and a portion of the connection wire wound thereon;

a spring member urging the pulley in a connection-winding direction;

a rotation prevention assembly constructed and arranged to, in a first state, allow the pulley to rotate and, in a second state, prevent free rotation of the pulley in a connection wire-feeding direction; and operation selection means for selectively causing the rotation prevention assembly to assume one of the first and second states;

wherein the rotation prevention assembly includes a rotatably mounted first member, a second member rotatable independently of the first member and connected to the pulley so that the second member rotates together with the pulley, connection means, interposed between the second member and the first member, for operatively connecting the second member and the first member to each other when the second member rotates in a connection wire-feeding direction relative to the first member, and a first member operation means for engaging the first member when the operation selection means causes the rotation prevention means to assume the second state, thus preventing rotation of the first member, and for disengaging from the first member when the operation selection means causes the rotation prevention means to assume the first state.

* * * * *